United States Patent [19]

Inoue

[11] Patent Number: 5,044,169

[45] Date of Patent: Sep. 3, 1991

[54] CONTROL DEVICE FOR USE IN AN AUTOMATIVE AIR CONDITIONING SYSTEM

[75] Inventor: Atsuo Inoue, Isesaki, Japan

[73] Assignee: Sanden Corporation, Japan

[21] Appl. No.: 378,861

[22] Filed: Jul. 12, 1989

[30] Foreign Application Priority Data

Jul. 12, 1988 [JP] Japan ..... 63-171891

[51] Int. Cl.[5] ..... F25B 41/00

[52] U.S. Cl. ..... 62/196.4; 62/DIG. 17; 165/38

[58] Field of Search ..... 62/DIG. 17, 196.4, 117; 165/38, 34, 40

[56] References Cited

U.S. PATENT DOCUMENTS

| | | | |
|---|---|---|---|
| 2,337,789 | 12/1943 | Whitney | 165/40 X |
| 2,869,330 | 1/1959 | Kramer | 62/196.4 |
| 3,145,543 | 8/1964 | Miner | 62/216 |
| 3,368,364 | 2/1968 | Norton et al. | 62/117 |
| 3,430,453 | 3/1969 | Norton | 62/196.4 |
| 3,500,653 | 3/1970 | Anderson | 62/218 |
| 3,934,425 | 1/1976 | Morris | 62/DIG. 17 |
| 3,942,332 | 3/1976 | Schumacher | 62/217 |
| 3,955,375 | 5/1976 | Schumacher | 62/217 |
| 4,123,914 | 11/1978 | Perez et al. | 62/196.4 |
| 4,286,437 | 9/1981 | Abraham et al. | 62/151 |
| 4,356,706 | 11/1982 | Baumgarten | 62/238.6 |
| 4,457,138 | 7/1984 | Bowman | 62/509 |
| 4,590,772 | 5/1986 | Nose et al. | 62/DIG. 17 |

*Primary Examiner*—William E. Wayner

*Attorney, Agent, or Firm*—Banner, Birch, McKie & Beckett

[57] ABSTRACT

An automotive air conditioning system includes a compressor with a variable displacement mechanism, a condenser, a decompression device and an evaporator serially arranged to form a closed refrigerant circulation path. A conduit connects an outer side of the compressor to an intermediate portion of a fluid conduit passing through the condenser. A pressure adjusting mechanism is disposed in the bypass conduit to adjust the pressure of refrigerant in the condenser. The pressure adjustment mechanism permits the automotive air conditioning system, which includes a compressor with a variable displacement mechanism, to maintain the amount of refrigerant circulated in the system at a desired level under small, as well as large, air conditioning loads.

12 Claims, 4 Drawing Sheets

CONTROL DEVICE FOR USE IN AN AUTOMATIVE AIR CONDITIONING SYSTEM

TECHNICAL FIELD

This invention relates to a control device for use in a refrigeration system, and more particularly, to a control device for controlling the pressure of refrigerant in a condenser in a refrigeration system which includes a compressor with a variable displacement mechanism.

BACKGROUND OF THE INVENTION

FIG. 1 illustrates a conventional automotive air conditioning system. The system includes compressor 1, having a variable displacement mechanism, condenser 2, receiver dryer 3, thermostatic expansion valve 4 and evaporator 5 serially connected. The output of evaporator 5 is connected to the input of compressor 1. Thermostatic expansion valve 4 controls the flow volume of the refrigerant which flows into evaporator 5. The operation of thermostatic expansion valve 4 is dependent upon the temperature of the refrigerant which flows out of evaporator 5.

Among the drawbacks associated with such prior art systems are, for example, the air conditioning load is extremely small and the compression ratio between the inlet and outlet port of the compressor also may be small. As a result, the quantity of refrigerant circulated in the system is very small. In turn, such circulation may give rise to various problems relating to lubrication, control of thermodynamic properties at the evaporator and evaporator cooling efficiencies discussed hereafter.

Lubrication oil normally is suspended in the refrigerant. Accordingly, a decrease in the quantity of circulated refrigerant decreases the quantity of lubrication oil circulated in the compressor. If after a period of such relatively low lubricant circulation, the automobile is driven at a relatively high speed wherein the rotational speed of compressor 1 correspondingly increases to a relatively high value, driving parts in compressor 1 may be damaged due to insufficient lubrication during the transition.

Further, in an automobile air conditioning system which includes fixed throttle valve 6 as a decompression mechanism and accumulator 7 at the outlet of evaporator 5 as shown in FIG. 2, inadequate lubricant circulation may occur. Specifically, lubrication oil which flows into accumulator 7 and accumulates therein, does not readily flow therefrom due to the decrease in the quantity of refrigerant circulating in the system. Accordingly, during stages when the rotational speed of compressor 1 is below its upper range, the driving parts in compressor 1 also may be damaged due to insufficient lubrication.

In addition, if the quantity of refrigerant circulated in the system is extremely small, the temperature change in the refrigerant at the outlet port of evaporator 5 also is small. Accordingly, the response to such small temperature changes in refrigerant temperature, which are detected at detecting portion 41 of thermostatic expansion valve 4 to control the position of valve 4, is very slow. Accordingly, it is difficult to control the valve so as to stabilize its position. As a result, the evaporating pressure and superheat at evaporator 5 are unstable. In turn, the temperature of the air which is conditioned by evaporator 5, varies in accordance with the above evaporator thermodynamic instability and thus reduces comfort in the passenger compartment.

Further complications may arise in an air conditioning system which incorporates an evaporator having a plurality of conduits. In such systems, the refrigerant is not effectively distributed into each conduit when the volume of refrigerant circulated in the system is small. Specifically, only gas-state refrigerant flows into particular conduits. Because liquid-state refrigerant does not flow into those conduits, the portion of the evaporator in which those conduits extend virtually does not contribute to cooling. As a result, the cooling efficiency of the evaporator decreases. Accordingly, small air conditioning load may produce low evaporator cooling efficiencies.

SUMMARY OF THE INVENTION

In view of the above and other deficiencies of the known prior art, it is a primary object of the present invention to provide a control device for use in an automotive air conditioning system including a compressor with a variable displacement mechanism which can maintain above a certain circulation volume of refrigerant in the system even under the small air conditioning load.

It is another object of the present invention to provide a control device for use in an automotive air conditioning system including a compressor with a variable displacement mechanism which can prevent the compressor from being damaged by lack of circulation volume of lubrication oil.

It is still another object of the present invention to provide a control device for use in an automotive air conditioning system including a compressor with a variable displacement mechanism which can improve the efficiency of an evaporator under the small air conditioning load.

It is yet another object of the present invention to provide a control device for use in an automotive air conditioning system including a compressor with a variable displacement mechanism which can stabilize air temperature at the outlet of an evaporator.

An automotive air conditioning system according to the present invention comprises at least a compressor with a variable displacement mechanism, a condenser, a decompression device and an evaporator serially arranged to form a closed refrigerant circulation path. A control device is associated between the compressor and condenser to control the pressure in the condenser. The control device includes a bypass conduit which connects an outlet side of the compressor with an intermediate portion of the condenser. A pressure adjusting mechanism is associated with the bypass conduit to adjust the pressure of refrigerant in the condenser.

Further objects, features and other aspects of this invention will be understood from the following detailed description of the preferred embodiment of this invention referring to the annexed drawings.

DETAILED DESCRIPTION OF THE PREFERRED EMBODIMENTS

Figure 3:
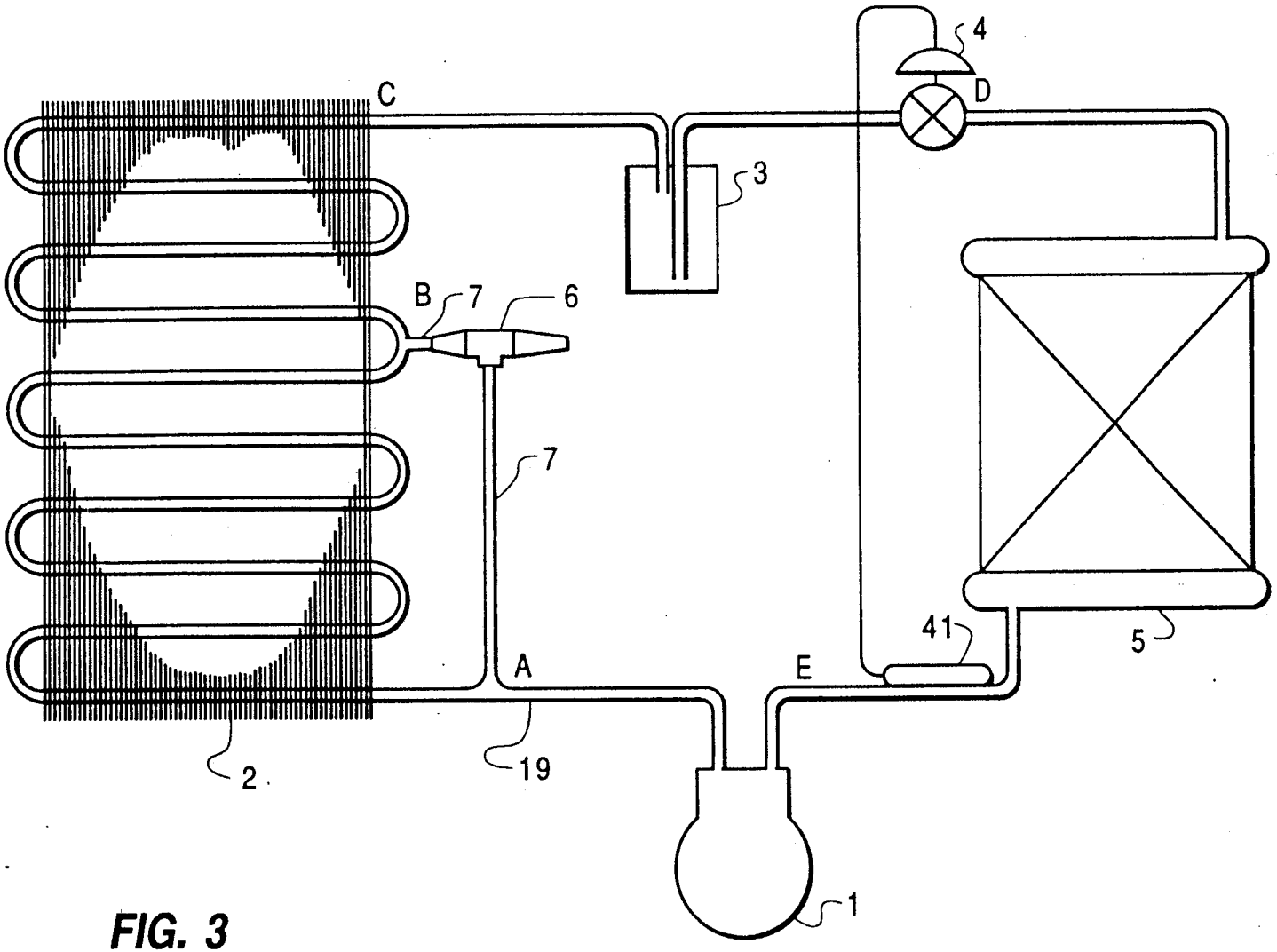
FIG. 3 is a schematic view of a refrigeration circuit in accordance with one embodiment of the present invention showing a front side view of the condenser pressure adjusting mechanism.

Referring to the drawings in detail wherein like numerals indicate like elements, FIG. 3 shows the construction of an automotive air conditioning system in accordance with one embodiment of the present invention. Conduit 19 connects the outlet port of compressor 1 with condenser 2 and merges with serpentine like conduit 2a which passes through condenser 2 along a tortuous path. Bypass conduit 10 connects conduit 19 with an intermediate portion of condenser 2 and thus bypasses a portion of conduit 2a. Condenser pressure adjusting valve 20 is disposed in bypass conduit 10 and controls the amount of fluid that flows therethrough.

Figure 4:
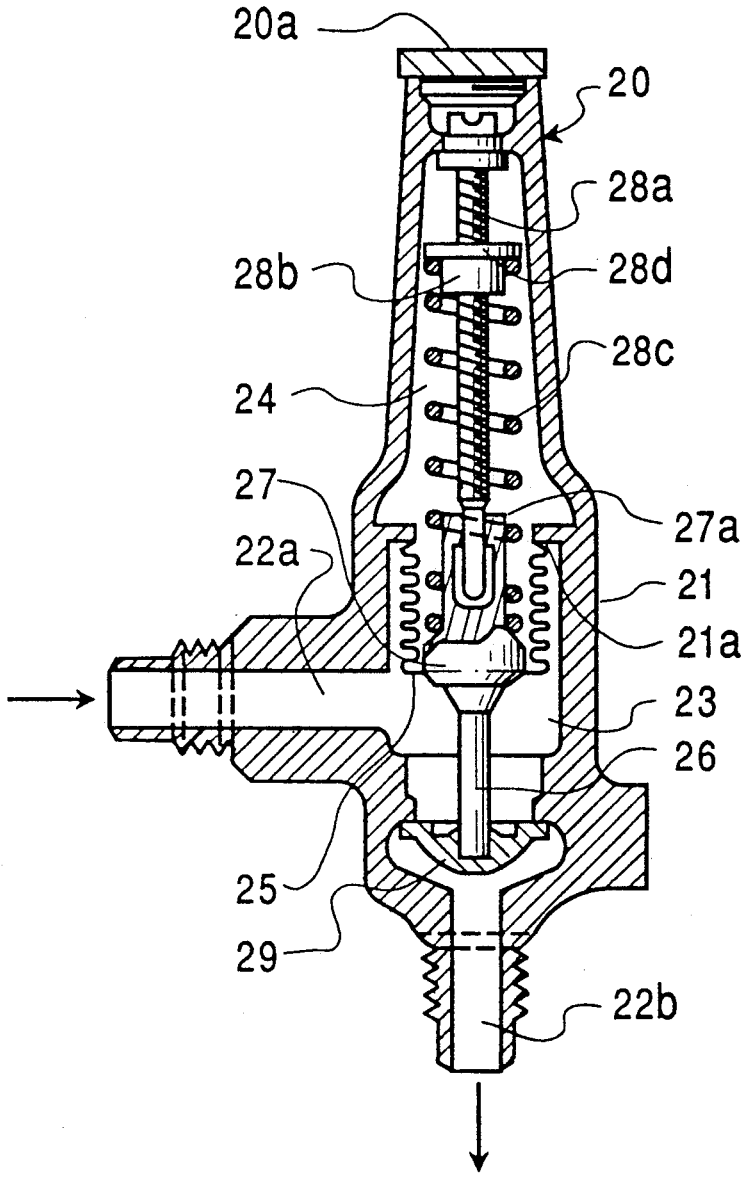
FIG. 4 is a rear side cross-sectional view of the condensing pressure adjusting mechanism shown in FIG. 3.

With reference to FIG. 4, the construction of condenser pressure adjusting valve 20 is shown. Adjusting valve 20 comprises casing 21 which includes inlet port 22a and outlet port 22b which interconnect adjusting valve 20 to bypass conduit 10. The interior of casing 21 is divided into first cylindrical chamber 23 and second cylindrical chamber 24. While viewing FIG. 4, the upper portion of second chamber 24 is closed by a plug or cap 20a. The plug or cap includes screw threads which mate with threads formed on the upper inner surface of casing 21. As the threads may not provide a seal, air outside valve 20 may pass through a gap between the threads, along threaded screw 28a and into second chamber 24. Thus, the pressure in second chamber 24 may be atmospheric pressure.

Cylindrical bellows 25, preferably made from brass or phosphor bronze, but which may be made from other suitable materials, is disposed in first chamber 23. A circumferential surface of one of the ends of bellows 25 is sealingly attached to flange portion 21a which projects radially inwardly from the inner surface of casing 21. A first end of connecting rod or valve stem 26 is connected to the other or second end of bellows 25 through guide rod 27 which serves as an extension to connecting rod 26. The second end of bellows 25, connecting rod 26 and guide rod 27 are associated to seal off the second end of bellows 25, and thus to form a seal between first chamber 23 and second chamber 24. Valve element 29 is connected to the other or second end of connecting rod 26 and translates axially to open and close the passageway of bypass conduit 10 in accordance with the operation of bellows 25.

An adjusting mechanism is disposed within second chamber 24 to adjust the initial extension of bellows 25. The adjusting mechanism comprises externally threaded screw 28a, internally threaded collar 28b and coil spring 28c. Screw 28a has one of its ends secured to casing 21 and its other or second end disposed in cylindrical hollow portion 27a within guide rod 27 to permit compression or relaxation of coil spring 28c. Collar 28b is disposed about the outer surface of screw 28a so that the collar threads engage with the screw threads. Accordingly, collar 28b may be axially translated along screw 28a when rotated. One end of coil spring 28a is secured about collar 28b, while the other end of coil spring 28c is secured to the outer surface of guide rod 27 to urge bellows 25 toward outlet port 23b when collar 28b is moved downwardly to compress coil spring 28c. Alternatively, the ends of coil spring 28c merely may be seated against member 28d and a portion of guide rod 27 within first chamber 23. Although FIG. 4 illustrates a coil spring recoil strength adjustment mechanism including the above described screw, collar and spring wherein the recoil strength of coil spring 28c is adjusted by moving collar 28b along screw 28a, other mechanisms may be used to adjust the coil spring recoil strength or the position of bellows 25.

Valve element 29 moves toward outlet port 22b and opens the valve passageway when:

$$P \times A_1 < Kx + Po \times A_2; \quad (1)$$

$$P < \frac{Kx}{A_1} + Po \text{ (as } A_1 \text{ and } A_2 \text{ have substantially the same value); or} \quad (2)$$

$$P < Pc, \text{ as} \quad (3)$$

$$Pc = \frac{Kx}{A_1} + Po$$

P is the pressure in first cylindrical chamber 23, $A_1$ is the effective area of bellows 25 within first chamber 23 subject to pressure P, x is the recoil strength of coil spring 28c, K is the spring constant for spring 28c, Po is atmospheric pressure, $A_2$ is the effective area of bellows 25 within second chamber 24 subject to pressure Po, and Pc is the predetermined balancing pressure of the pressure adjusting valve. Accordingly, the force on bellows 25 due to pressure opposes the sum of the spring force and the force on bellows 25 due to the pressure in second chamber 24. Thus, the resultant force determines the opening of the valve. Equation (3) represents that when pressure P in first chamber 23 is below predetermined pressure Pc, valve element 29 begins to translate and open the passage.

The operation of pressure adjusting valve 20 is described hereafter. Adjusting valve 20 detects the pressure of refrigerant at inlet port 22a and controls the opening of valve element 29 so that the refrigerant pressure at inlet port 22a is maintained at a predetermined pressure. Specifically, when the detected pressure is below the predetermined pressure, valve element 29 opens valve 20 so that superheated gas, discharged from compressor 1, may branch in two directions at point A, i.e., the superheated gas may flow into condenser 2 and bypass conduit 10. The gas which flows into condenser 2 is cooled, and thus condensed, within condenser 2. Accordingly, the gas entering condenser conduit 2a changes to a two phase condition so that a gas-liquid fluid flows to merging point B. The gas which flows into bypass conduit 10 and passes through adjusting valve 20 also flows to merging point B. Therefore, the gas which flows through bypass conduit 10 is not cooled and changed to a gas-liquid fluid until it flows into condenser conduit 2a at point B.

The relationship between the proportion of the quantity of gas refrigerant, which flows through bypass conduit 10, to the entire quantity of refrigerant circulated in the system and condensing pressure is that since radiating volume of condenser 2 reduces if the proportion of the quantity of the gas refrigerant which flows into bypass conduit 10 increases, condensing pressure also increases.

Figure 1:
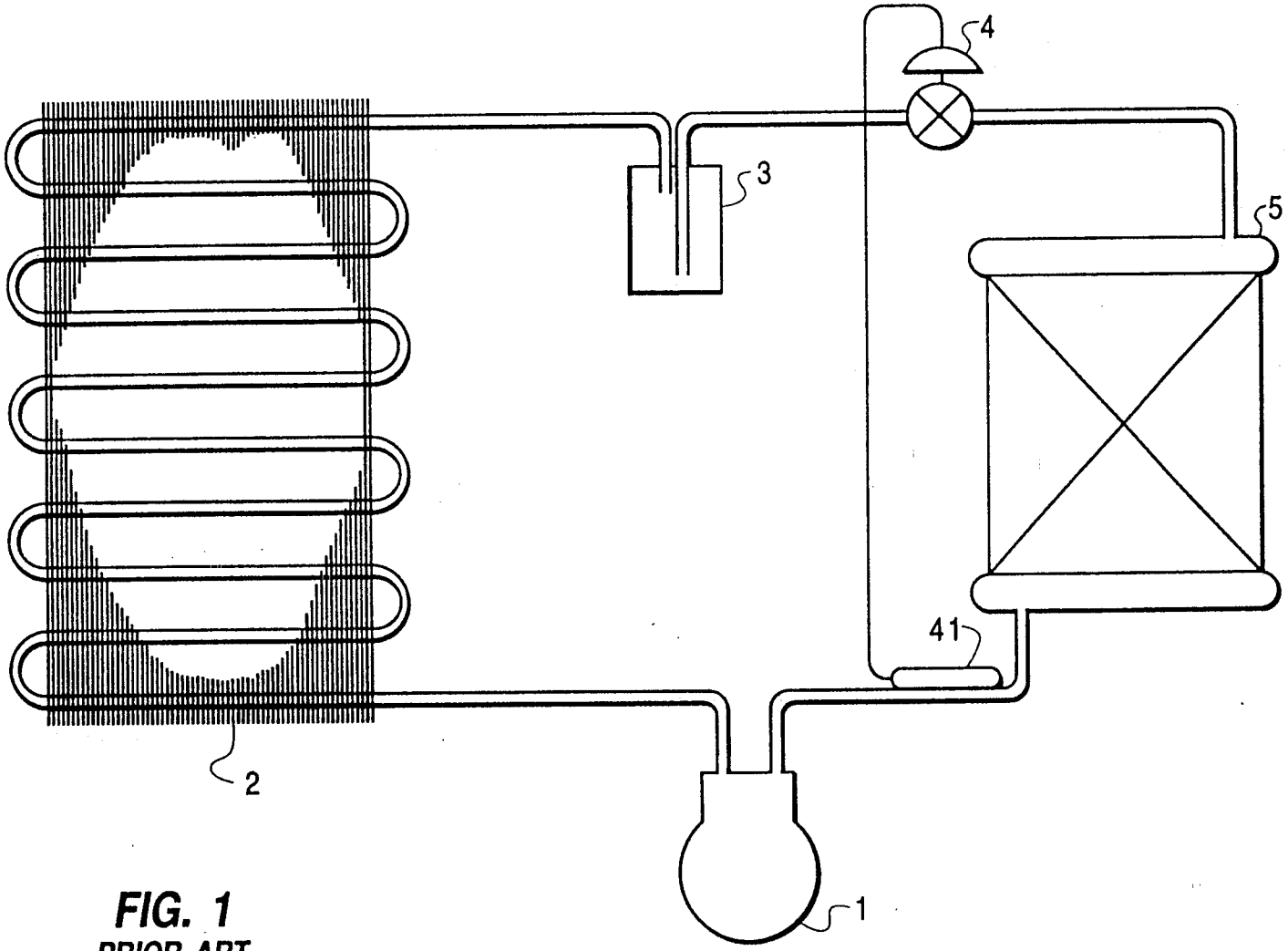
FIG. 1 PRIOR ART
FIG. 1 is a schematic view of a conventional refrigeration circuit.
Figure 2:
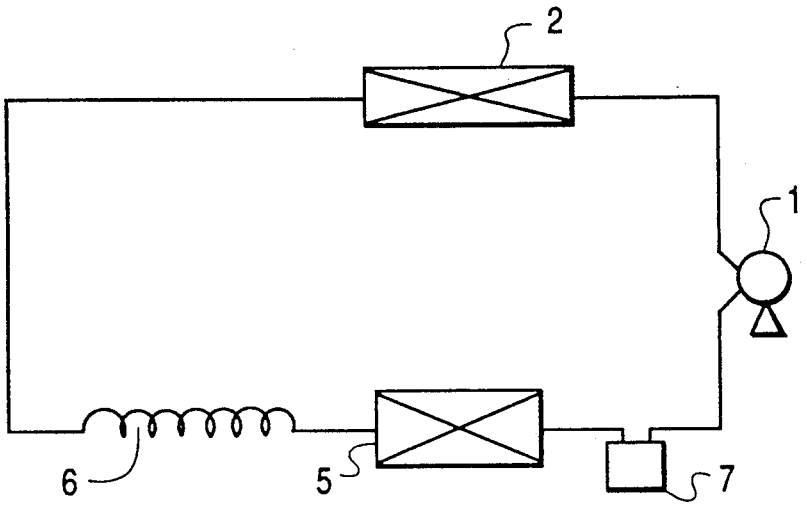
FIG. 2 PRIOR ART
FIG. 2 is another schematic view of a conventional refrigeration circuit.
Figure 5:
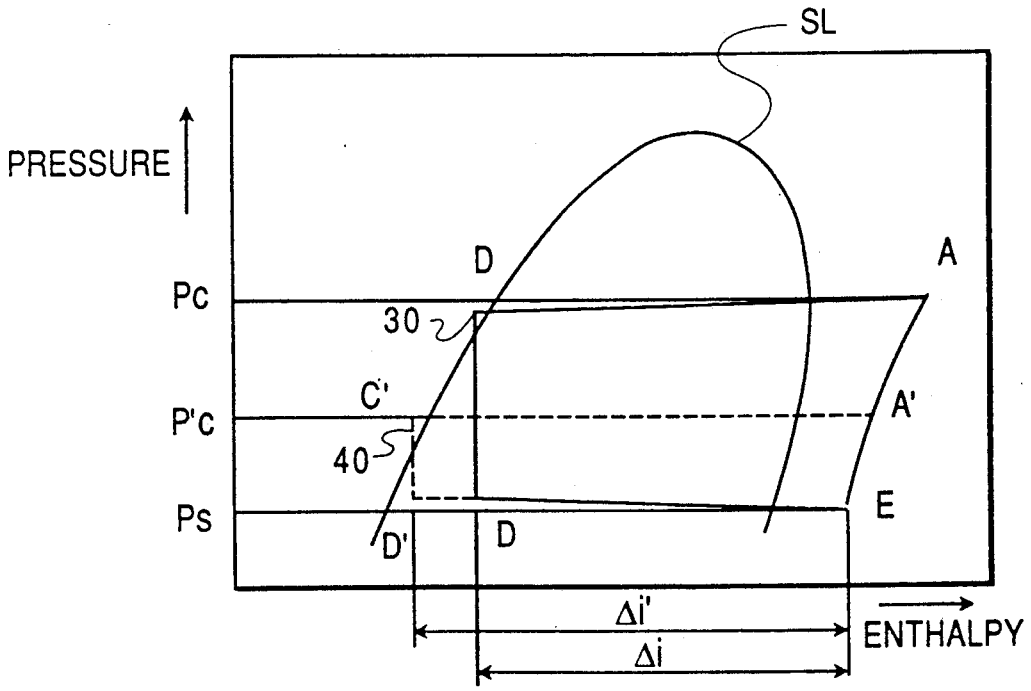
FIG. 5 is a graph which shows the relationship between a pressure and enthalpy.

Referring to FIG. 5, the relationship between pressure and enthalpy is shown. Solid-curved line SL represents the saturation liquid line. Cycle 30 is a cycle in accordance with the invention and is represented by a solid line SL, while conventional cycle 40, corresponding to the prior art discussed above, under the same air conditioning load as in cycle 30 is represented by a dotted line. Pc is a predetermined condensing pressure in accordance with that set by adjusting valve 20. Pc' is the condensing pressure in a cycle under the same conditions as in cycle 30. However, Pc' relates to a refrigeration circuit which does not include a condenser pressure adjusting valve, e.g., adjusting valve 20. Ps is the suction pressure in a compressor having a variable displacement mechanism in accordance with the volume of gas discharged from the compressor and the conditions of the air conditioning load. The following equation represents endothermic volume Q in cycle 30.

$$Q=\Delta i\times Gr \tag{4}$$

wherein, Δi is enthalpy difference of the refrigerant between inlets D and E of evaporator 5 and compressor 1, and Gr is a circulation volume of refrigerant.

Endothermic volume Q' in cycle 40 is represented by the following equation:

$$Q'=\Delta i'\times Gr' \tag{5}$$

wherein, Δi' is enthalpy difference of the refrigerant between inlets D' and E of evaporator 5 and compressor 1, and Gr' is the mass flow rate of refrigerant.

Since cycles 30 and 40 include a compressor with a variable displacement mechanism, which can maintain the suction pressure at a certain value, if the air conditioning load to both cycles is the same, an endothermic volume to an evaporator is always maintained at a certain value.

Accordingly, endothermic volume Q and Q' in the above equations (4) and (5) are represented by the following equations:

$$Q=Q' \tag{6}$$

$$\Delta i\times Gr=\Delta' i\times Gr' \tag{7}$$

The relationship between Δi and Δi' can be understood from FIG. 5 as follows:

$$\Delta i<\Delta i' \tag{8}$$

Accordingly, the relationship between Gr and Gr' can be understood from equations (7) and (8) as follows:

$$Gr>Gr' \tag{9}$$

Therefore, the quantity of refrigerant circulated in cycle 30 is greater than that in cycle 40. That is, if condensing pressure is maintained above a certain value, a suitable volume and quantity of refrigerant can be circulated.

This invention has been described in detail in connection with preferred embodiments. These embodiments, however, are merely for example only and the invention is not restricted thereto. It will be easily understood by those skilled in the art that other variations and modifications can be easily made within the scope of the invention, which is defined by the following claims.

I claim:

1. An automotive air conditioning system comprising:

a compressor having a variable displacement mechanism and an outlet side, a condenser, a decompression device, an evaporator;

said compressor, condenser, decompression device and evaporator being serially arranged to form a closed refrigerant circulation path, and a control device associated between the compressor and condenser, said control device comprising:

a bypass conduit connecting said outlet side of said compressor with an intermediate portion of said condenser; and pressure adjusting means associated with said bypass conduit for adjusting the pressure of refrigerant in said condenser said outlet side of said compressor having a first flow path and a second flow path, said first flow path being from an inlet of said condenser through the entire condenser, said second flow path being through said bypass conduit and thence through an intermediate portion of said condenser.

2. The automotive air conditioning system of claim 2 wherein said pressure adjusting means comprises a valve having means for controlling fluid flow from said outlet side of the compressor, through said bypass conduit and to an intermediate portion of said condenser in response to refrigerant pressure in said condenser.

3. The automotive air conditioning system of claim 2 wherein said control means provides fluid communication from said outlet side of the compressor, through said bypass conduit and to an intermediate portion of said condenser in response to refrigerant pressure in said condenser being below a predetermined value.

4. The automotive air conditioning system of claim 2 wherein said control means comprises a valve element and actuation means for actuating the valve element to change its position within a passage formed through said valve.

5. The automotive air conditioning system of claim 4 wherein said actuation means comprises a spring having one end associated with said valve element.

6. The automotive air conditioning system of claim 5 wherein said control means further includes means for applying a force against the other end of said spring to compress the same.

7. The automotive air conditioning system of claim 6 wherein said valve comprises a valve body having a first chamber in fluid communication with said bypass conduit and a second chamber sealed from said bypass conduit.

8. The automotive air conditioning system of claim 7 wherein said valve element includes a valve stem disposed in said first chamber, said spring element being disposed in said second chamber.

9. The automotive air conditioning system of claim 1 further including a receiver dryer disposed between said condenser and said decompression device.

10. The automotive air conditioning system of claim 1 wherein said decompression device is a thermostatic expansion valve.

11. The automotive air conditioning system of claim 1 wherein said decompression device is a fixed expansion valve.

12. The automotive air conditioning system of claim 1 further including an accumulator disposed between said evaporator and said compressor wherein said compression device is a fixed expansion valve.

* * * * *